United States Patent [19]

Ishiguro et al.

[11] Patent Number: 4,863,337

[45] Date of Patent: Sep. 5, 1989

[54] CONTROL SYSTEM FOR WORKING MACHINE HAVING BOOM

[75] Inventors: Toshio Ishiguro; Hideaki Mizota; Tuyoshi Aoki, all of Osaka, Japan

[73] Assignee: Kubota, Ltd., Osaka, Japan

[21] Appl. No.: 173,622

[22] Filed: Mar. 25, 1988

[30] Foreign Application Priority Data

Apr. 3, 1987 [JP] Japan ..... 62-51283
Nov. 6, 1987 [JP] Japan ..... 62-170432

[51] Int. Cl.[4] ..... B66C 3/00

[52] U.S. Cl. ..... 414/699; 60/459; 91/361; 74/471 XY; 267/150; 137/636.2; 244/227; 180/333

[58] Field of Search ..... 414/687, 694, 699; 180/333; 74/471 XY; 267/150; 137/636.2; 91/361; 60/459; 244/223, 236, 227

[56] References Cited

U.S. PATENT DOCUMENTS

| | | | |
|---|---|---|---|
| 2,329,742 | 9/1943 | Bush et al. | 180/333 X |
| 3,038,451 | 6/1962 | Sporn et al. | 91/361 X |
| 3,904,051 | 9/1975 | Tsuchiya et al. | 414/694 |
| 4,477,043 | 10/1984 | Repperger | 244/223 |
| 4,721,274 | 8/1985 | Erb | 74/471 XY X |

FOREIGN PATENT DOCUMENTS

| | | | |
|---|---|---|---|
| 0112525 | 7/1982 | Japan | 414/699 |

*Primary Examiner*—Robert J. Spar
*Assistant Examiner*—Donald W. Underwood
*Attorney, Agent, or Firm*—Birch, Stewart Kolasch & Birch

[57] ABSTRACT

A control system for a working machine which has a boom equipped with a working implement at its forward end and pivoted to a vehicle body movably about a vertical axis, and control valve for controlling the movement of the boom. The system comprises a variable resistor for setting a target position where the boom is to be stopped to produce a setting signal, a sensor for detecting the moved position of the boom to produce a detection signal, differential device for determining the difference between the setting signal and the detection signal to produce a difference signal, a detector for detecting the direction of movement of the boom from the magnitude of the difference signal, a pulse-width modulator for subjecting the difference signal to pulse-width modulation to produce a pulse signal, and a driver for driving the control valve by the pulse signal in the detected direction in proportion to the difference signal.

11 Claims, 7 Drawing Sheets

CONTROL SYSTEM FOR WORKING MACHINE HAVING BOOM

FIELD OF THE INVENTION AND RELATED ART STATEMENT

The present invention relates to control systems for boom-equipped working machines such as backhoes.

Working machines such as backhoes have a boom equipped with a working implement at its forward end and pivoted to a vehicle body movably about a vertical axis for performing the contemplated work with the implement.

The backhoe comprises a machine frame attached to a vehicle body, a pivotal frame mounted on the machine frame and movable about a vertical axis by the extension or contraction of pivotal cylinders, a boom connected to the pivotal frame and upwardly or downwardly movable about a horizontal axis by the extension or contraction of a boom cylinder, a bucket angularly movably attached to an arm connected to the free end of the boom, and a control valve coupled to control levers and adapted to control the pivotal cylinders, the boom cylinder, an arm cylinder and a bucket cylinder.

When the backhoe is used for excavation, the boom must be moved sidewise to a position along with the pivotal frame for dumping out the earth scooped up with the bucket. During excavation, therefore, the boom needs to be moved repeatedly between the excavating position and the dumping position. The conventional machine accordingly has the drawback of necessitating very cumbersome skillful manipulation of the control levers Especially when the cavity to be formed has a small width, there arises a need to stop the boom accurately at the excavating position after dumping, but it is difficult to stop the boom properly at the desired excavating position at all times. Accordingly, it is frequent practice to temporarily stop the boom in the vicinity of the desired stopping position and thereafter move the boom from the overrun or underrun position to the desired position by operating the pivotal cylinder again by slow degrees.

Furthermore, the boom must be returned to the excavating position with the arm and bucket controlled to a proper posture for the subsequent excavating action, so that the operator is unable to direct his attention only to the control of the boom when stopping the boom in position.

A control system for boom-equipped working machines is known which comprises a single control lever movable about two axes intersecting each other at right angles, a mechanical control valve operable by the lever, and a boom moving control valve operable also by the lever through electrical instruction means.

With this control system, the control lever is movable with much lower resistance when operating the electrical instruction means than when operating the mechanical control valve. The control lever therefore feels very different when moved for operating these two components. In the case where an electromagnetic valve of the proportional type is used as the boom moving control valve and is made operable by the control lever in proportion to the amount of movement of the lever, it is likely that the control lever, which is movable with reduced resistance, will be moved more than is needed, causing the boom to move inadvertently at a great speed. Another problem is also encountered in that it is difficult to control the speed of movement of the boom as desired when the boom is to be returned and stopped at the excavating position.

OBJECTS AND SUMMARY OF THE INVENTION

The present invention has been accomplished in order to overcome the foregoing problems heretofore experienced.

More specifically, a first object of the invention is to provide a control system by which when a target position where the boom is to be stopped is set before starting work, the boom can be automatically stopped invariably at the target position during work.

Another object of the invention is to provide a control system which is adapted to smoothly stop the boom at the target position by gradually decreasing the speed of movement of the boom as it approaches the target position.

To fulfill these first and second objects, the present invention provides a control system for a working machine which has a boom equipped with a working implement at its forward end and pivoted to a vehicle body movably about a vertical axis, and a control valve for controlling the movement of the boom, the control system comprising means for setting a target position where the boom is to be stopped, means for detecting the moved position of the boom, differential means for determining the difference between a setting signal from the setting means and a detection signal from the position detecting means to produce a difference signal, means for judging the direction of movement of the boom from the magnitude of the difference signal from the differential means, pulse-width modulation means for subjecting the difference signal to pulse-width modulation to produce a pulse signal, and drive means for driving the control valve by the pulse signal in the direction of movement of the boom judged by the judging means in proportion to the difference signal.

A third object of the invention is to provide a control system having a control lever which is movable with substantially the same resistance without awkward feeling for operating a mechanical control valve and for operating electric control means.

To achieve the third object, the present invention provides a control system for a working machine which has a boom equipped with a working implement at its forward end and pivoted to a vehicle body movably about a vertical axis, and a control lever movable about two axes intersecting each other at right angles for operating a mechanical control valve and electric instruction means, the boom being pivotally movable by a control valve in response to an instruction given by the instruction means to the valve, the control lever being provided at its base portion with resistance means for giving resistance to the control lever so as to render the control lever movable with substantially the same resistance for operating the instruction means and for operating the mechanical control valve.

BRIEF DESCRIPTION OF THE DRAWINGS

FIG. 1 is an overall side elevation;

FIG. 2 is a plan view in section showing a pivotal frame assembly;

FIG. 3 is a rear view of an outrigger assembly;

FIG. 4 is a plan view of a control box;

FIG. 5 is a hydraulic circuit diagram;

FIG. 6 is an electric circuit diagram;

FIG. 7 is a waveform diagram;

FIG. 8 is a diagram illustrating the operation of the embodiment;

FIG. 9 is a front view in section showing a control unit;

FIG. 10 is a plan view in section of the same;

FIG. 11 is a side elevation in section of the same;

FIG. 12 is a sectional view showing resistance means;

FIG. 13 is a plan view of a control box; and

FIG. 14 is a block diagram showing an electric circuit.

DESCRIPTION OF THE PREFERRED EMBODIMENTS

The present invention will be described below in detail with reference to the illustrated embodiments.

FIGS. 1 to 8 show a first embodiment of the invention which comprises a tractor, and a front loader and a backhoe attached to the front and rear portions of the tractor, respectively.

Figure 1:
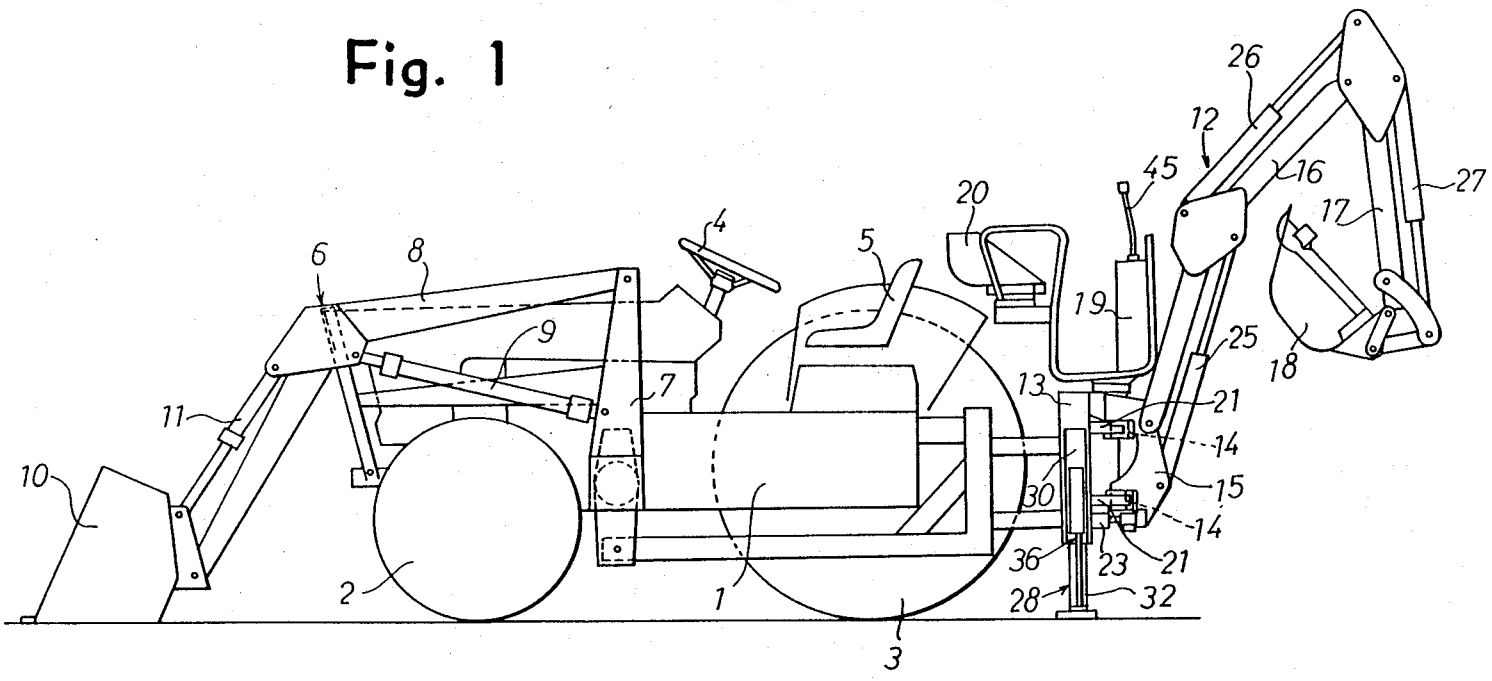
FIGS. 1 to 8 show an embodiment of the invention.

Referring to FIG. 1, the tractor has a body 1, front wheels 2, rear wheels 3, a steering wheel 4 and a driver's seat 5.

Indicated at 6 is the front loader attached to the front end of the tractor body 1 and comprising masts 7 attached to the respective lateral sides of the body 1, a boom 8 pivotally supported by the upper ends of the masts 7 and movable upward and downward, a boom cylinder 9 for raising or lowering the boom 8, a bucket 10 pivoted to the forward end of the boom 8, and a bucket cylinder 11 for moving the bucket 10.

Indicated at 12 is the backhoe attached to the rear end of the tractor body 1. The backhoe 12 comprises a machine frame 13 attached to the tractor body 1, a pivotal frame 15 supported by the machine frame 13 and swingable about vertical pivots 14, a boom 16 pivoted to the pivotal frame 15 and movable upward and downward about a lateral axis, an arm 17 pivoted to the forward end of the boom 16 and movable upward and downward, a bucket 18 pivoted to the forward end of the arm 17, a control box 19 mounted on the pivotal frame 15, and an operator's seat 20.

Figure 2:
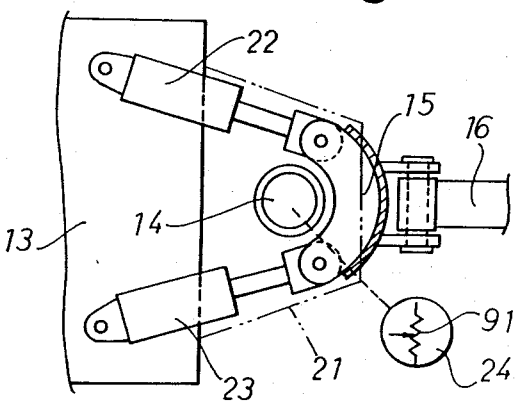

With reference to FIG. 2, the pivotal frame 15 is supported by the vertical pivots 14 on a pair of upper and lower brackets 21 projecting rearward from the machine frame 13 and is moved by a pair of opposed frame cylinders 22, 23 connected between the machine frame 13 and the pivotal frame 15 and positioned close to the lower bracket 21. The pivotal frame 15 is provided with position detecting means 24 for detecting the moved position of the frame 15. The position detecting means 24 comprises a variable resistor 91 for giving a detection signal varying with the moved position of the pivotal frame 15.

The boom 16 and the arm 17 are moved upward and downward by a boom cylinder 25 and an arm cylinder 26, respectively. The bucket 18 is pivotally moved by a bucket cylinder 27.

Figure 3:
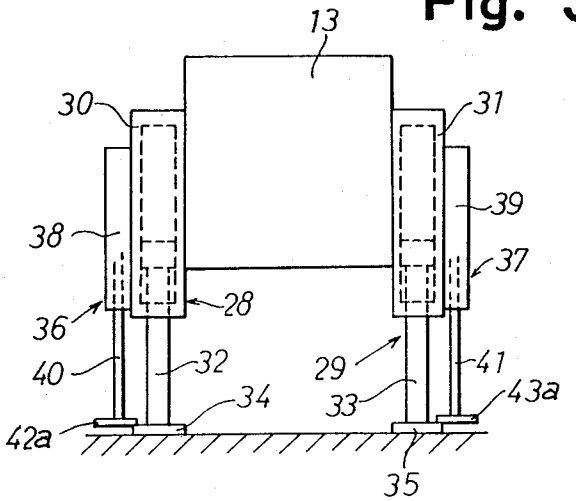

With reference to FIG. 3, the machine frame 13 is provided with outriggers 28 and 29 at its respective sides. Each outrigger 28 (29) is in the form of a hydraulic cylinder comprising a cylinder body 30 (31) positioned vertically and attached to the machine frame 13 and a piston rod 32 (33) having a ground contact plate 34 (35) attached to its lower end. The outrigger 28 (29) has sinking amount detecting means 36 (37) movable with the contact plate 34 (35) vertically for detecting the amount of sinking of the plate 34 (35). The detecting means 36 (37) comprises a tubular sensor body 38 (39) attached to the cylinder body 30 (31), a rod 40 (41) vertically slidably inserted in the sensor body, and a sensor plate 42*a* (43*a*) attached to the lower end of the rod. The sliding movement of the rod 40 (41) relative to the sensor body 38 (39) varies the value of a variable resistor 42 (43) incorporated in the sensor body 38 (39). The sensor plate 42*a* (43*a*) engages with the contact plate 34 (35) from above and comes into contact with the ground surface when the contact plate 34 (35) sinks.

Figure 4:
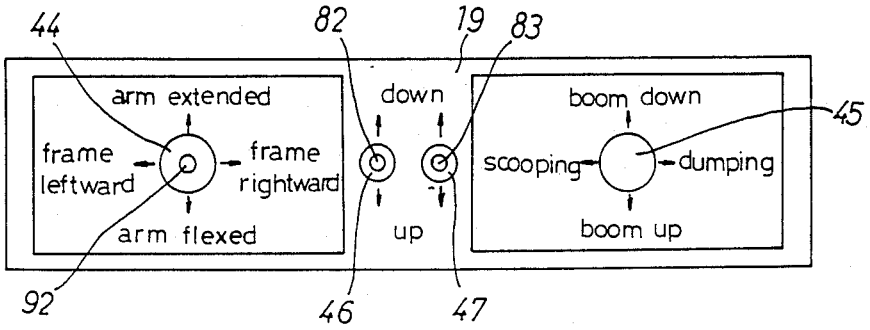
Figure 11:
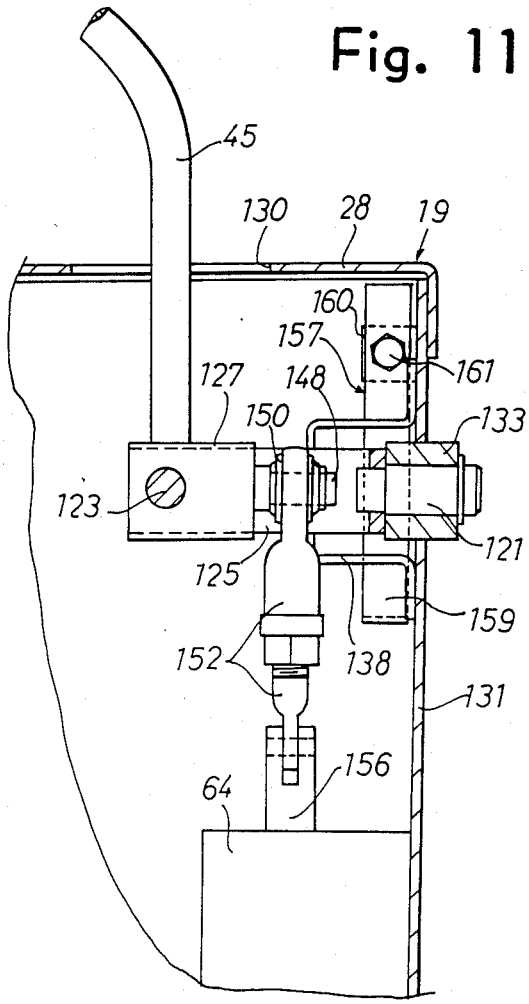

With reference to FIG. 4, the control box 19 is provided on its upper side with two control levers 44, 45 pivotally movable forward and rearward, and rightward and leftward about two axes intersecting each other at right angles, and two control levers 46, 47 pivotally movable forward and rearward. The control lever 44 moves the pivotal frame 15 rightward or leftward when shifted rightward or leftward and moves the arm 17 upward or downward when shifted forward or rearward. The control lever 45 causes the bucket 18 to perform a scooping or dumping action when shifted leftward or rightward and moves the boom 16 downward or upward when shifted forward or rearward. The control levers 46, 47, which are provided for the outriggers 28, 29, varies the values of the variable resistors 48, 49, respectively, when shifted forward or rearward.

Figure 5:
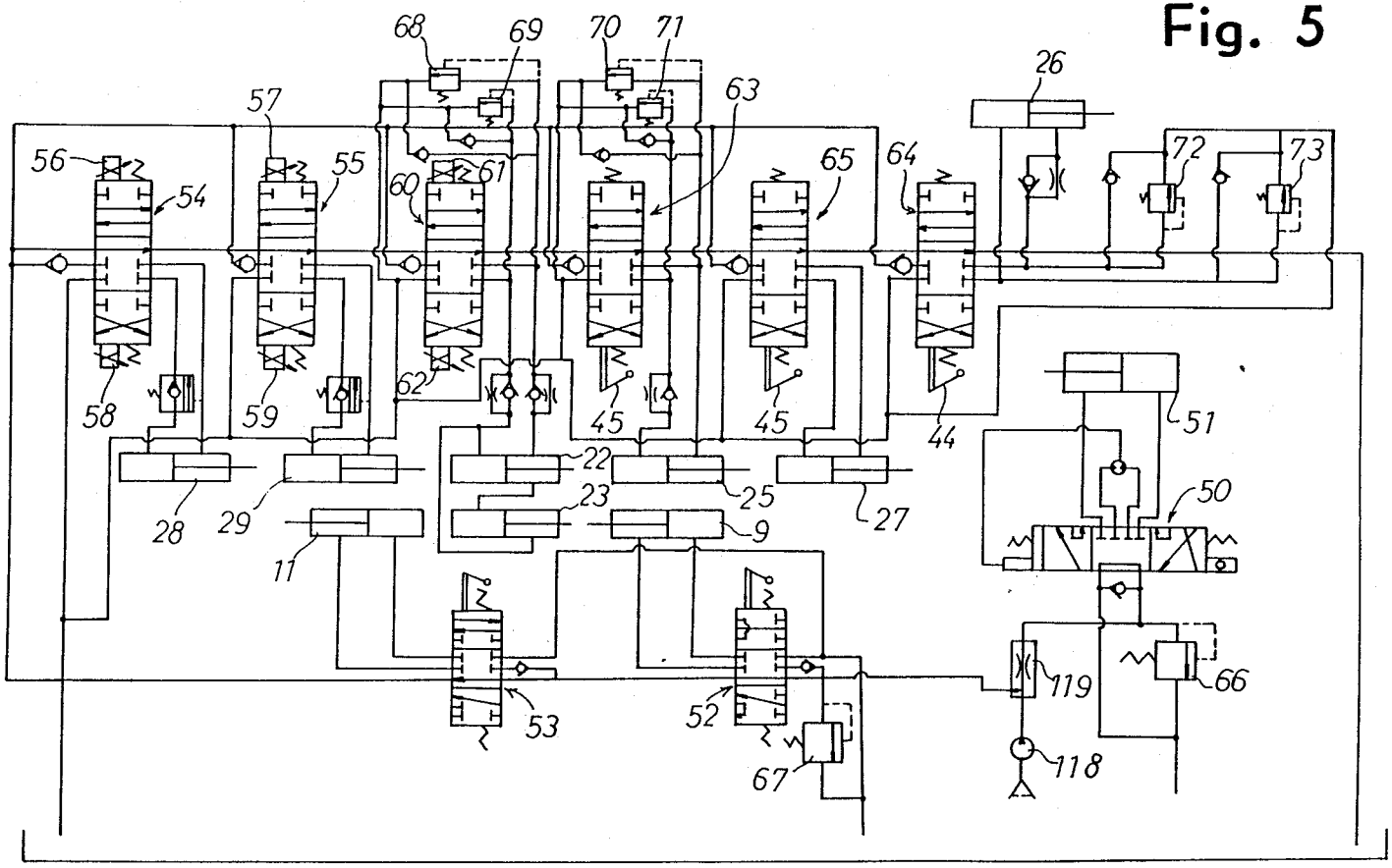

FIG. 5 shows a hydraulic circuit. A hydraulic pump 118 is driven by the engine on the tractor body 1. Indicated at 119 is a flow rate preference valve, at 50 a steering valve coupled to the steering wheel 4 for steering the front wheels 2 by a steering cylinder 51, at 52 a boom control valve for the front loader 6, and at 53 a bucket control valve for the front loader 6. These control valves 52, 53 are manually operated for controlling the boom cylinder 9 and the bucket cylinder 11.

Electromagnetic control valves 54, 55 of the flow rate proportional type for controlling the outriggers 28, 29 comprise raising solenoids 56, 57 and lowering solenoids 58, 59, respectively. An electromagnetic valve 60 of the flow rate proportional type for controlling the frame cylinders 22, 23 comprises a left solenoid 61 and a right solenoid 62. A boom control valve 63 for controlling the boom cylinder 25 of the backhoe 12 is operated by the forward or rearward shift of the control lever 45. An arm control valve 64 for controlling the arm cylinder 26 is operated by the forward or rearward shift of the control lever 44. A bucket control valve 65 for controlling the bucket cylinder 27 is operated by the rightward or leftward shift of the control lever 45. Indicated at 66 to 73 are relief valves.

Figure 6:
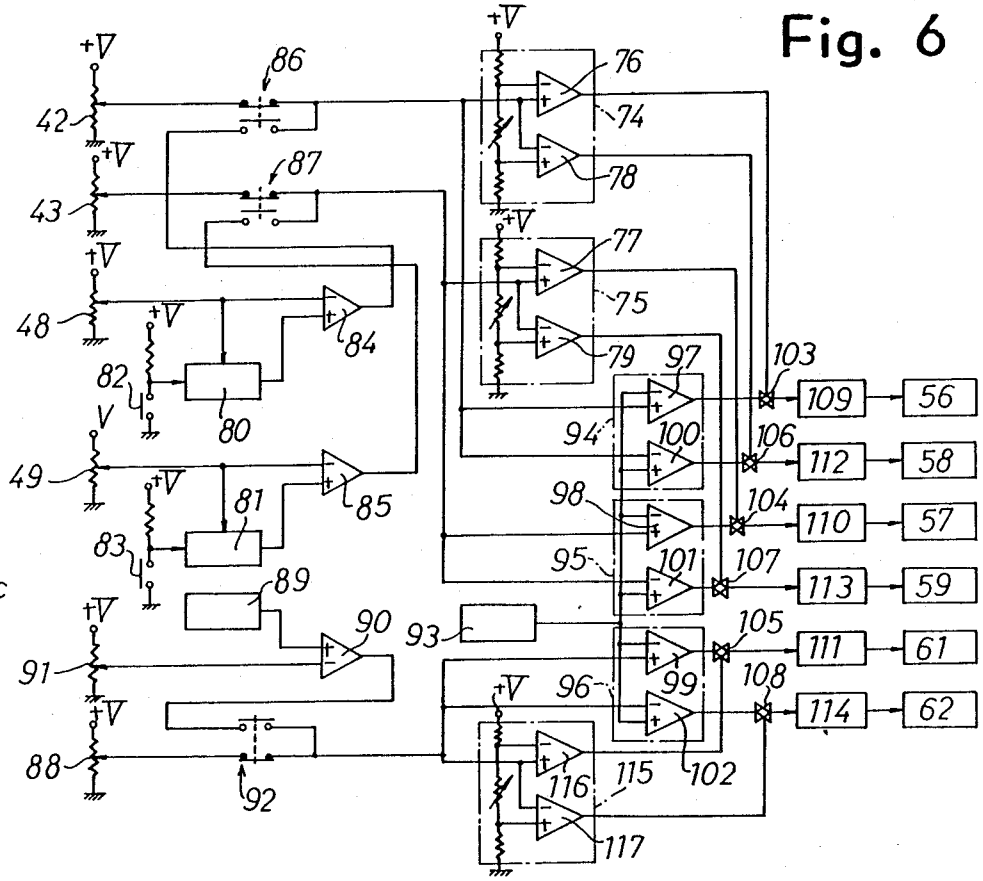

FIG. 6 shows an electric circuit for controlling the electromagnetic valves 54, 55 and 60. Each variable resistor 42 (43) for instructing the outrigger 28 (29) to rise or lower is coupled to the control lever 46 (47). Up-down (rasing-lowering) judging means 74 (75) comprises an up comparator 76 (77) and a down comparator 78 (79). The up comparator 76 (77) produces an up signal when the instruction signal from the variable resistor 42 (43) is greater than an up reference value. The down comparator 78 (79) produces a down signal when the instruction signal is smaller than a down reference signal.

Memory means 80 (81) comprising a sample holding circuit stores as a setting signal the detection signal from the variable resistor 48 (49) of the sinking amount detecting means 36 (37) when a switch 82 (83) at the upper end of the control lever 46 (47) is turned on. Differential means 84 (85) compares the detection signal from the variable resistor 48 (49) with the setting signal from the memory means 80 (81) to determine the difference therebetween to produce a difference signal when the detection signal is smaller than the setting signal.

A manual-automatic change switch 86 (87) selectively connects the resistor 42 (43) or the differential means 84 (85) to the subsequent portion of the electric circuit. These change switches 86, 87 are operatively connected to each other.

A variable resistor 88 included in frame movement instruction means is coupled to the control lever 44 when the lever is shifted rightward or leftward to produce an instruction signal which varies in proportion to the amount of shift of the lever 44.

Setting means 89 comprises a variable resistor for setting a target position where the pivotal frame 15 is to be stopped to produce a setting signal. Differential means 90 determines the difference between the detection signal from the variable resistor 91 of the position detecting means 24 and the setting signal from the setting means 89 to produce a difference signal. A manual-automatic change switch 92 for the control of the pivotal frame 15 selectively connects the variable resistor 88 of the instruction means or the differential means 90 to the subsequent portion of the electric circuit. The change switches 86, 87 are mounted on the top of the control box 19.

Figure 7:
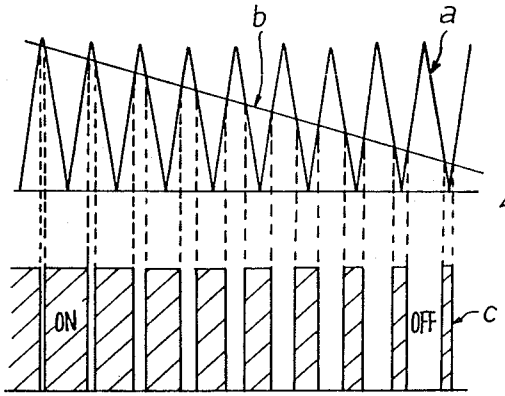

A triangular wave oscillator 93 produces a triangular wave signal a of specified frequency as shown in FIG. 7. A frame movement judging means 115 comprises left and right comparators 116, 117, compares the instruction signal from the resistor 88 with a reference valve and produces a leftward movement signal or a rightward movement signal according to the result. Pulse-width modulation means 94 (95, 96) subjects the signal b from the variable resistor 42 (43, 88) or the differential means 84 (85, 90) to pulse-width modulation with the triangular wave signal a and comprises two comparators 97 (98, 99) and 100 (101, 102). The comparator 97 (98, 99) is in reverse relation to the comparator 100 (101, 102) as to the input. The comparator 97 (98, 99) produces a pulse signal c which is on when the signal b is greater than the triangular signal a and which is off when the signal b is smaller as seen in FIG. 7. Conversely, the comparator 100 (101, 102) produces a pulse signal c which is on when the signal b is smaller than the triangular signal a and which is off when the signal b is greater. The output terminals of the comparators 97 to 102 are connected to the corresponding solenoids 56 to 62 of the control valves 54, 55, 60 via analog switches 103 to 108 and drive means 109 to 114, respectively. The electromagnetic control valve 54 (55, 60) is driven by the pulse signal from the comparator 97 or 100 (98 or 101, 99 or 102) in proportion to the signal from the variable resistor 42 (43, 88) or the differential means 84 (85, 90).

The analog switches 103 to 108 are turned on in response to a signal from the comparators 76, 77, 78, 79, 116, 117 of the judging means 74, 75, 115.

The control system of the above construction operates as follows. When the backhoe 12 is to be used for excavation, the boom 8 of the front loader 6 is lowered to place the bucket 10 on the ground, and the outriggers 28, 29 on the opposite sides of the machine frame 13 adjacent the backhoe 12 are operated to lower their ground contact plates 34, 35 into contact with the ground. Thus, the tractor body 1 is supported by the front loader 6 and the pair of outriggers 28, 29.

To lower the pair of outriggers 28, 29, the control levers 46, 47 are shifted forward, whereby the resistance value of the variable resistors 42, 43 is decreased to produce an instruction signal in proportion to the amount of shift of the levers. When fed to the judging means 74, 75, the instruction signal, which is small, is interpreted as a down instruction by the comparators 78, 79, which in turn produce a down signal to turn on the analog switches 106, 107. On the other hand, the instruction signal b is fed to the comparators 97, 98, 100, 101 of the pulse-width modulation means 94, 95 and compared with the triangular wave signal a of the oscillator 93. Since the instruction signal is lower than the midpoint voltage in this case, the comparators 100, 101 compare the two signals and produce a pulse signal c which is on when the instruction signal b is smaller than the signal a in reverse relation to the signal c shown in FIG. 7. The pulse width of the signal c is greater when the difference between the two signals is greater. Consequently, the drive means 112, 113 are operated via the analog switches 106, 107, energizing the down solenoids 58, 59 of the valves 54, 55 and thereby opening the valves 54, 55 at the down side to a degree in proportion to the pulse width to supply the working fluid to the cylinder bodies 30, 31 of the outriggers 28, 29. As a result, the contact plates 34, 35 are lowered to the ground. In this case, the outriggers 28, 29 operate at a speed in proportion to the amount of shift of the control levers 46, 47, so that the plates can be lowered at the desired speed.

When the tractor body 1 is brought to a horizontal position with the contact plates 34, 35 on the ground, the levers 46, 47 are returned to the neutral position to stop the descent of the outriggers 28, 29. The manual-automatic change switches 86, 87 are closed for the automatic side for the operation of the backhoe 12.

Figure 8:
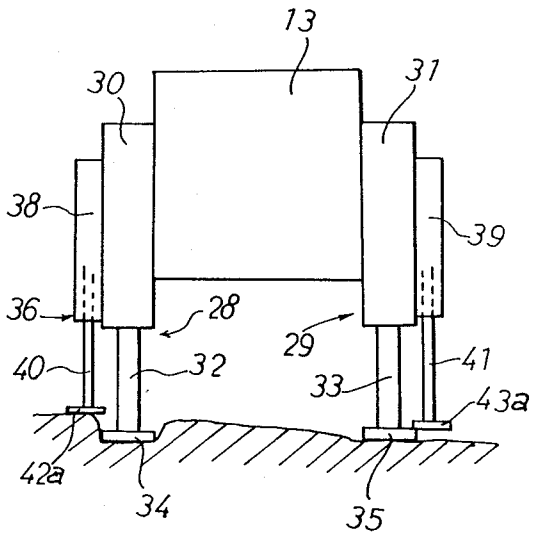

When the switches 86, 87 are held closed at the automatic side, the tractor body 1 can be kept generally horizontal at a specified level above the ground at all times during work. More specifically stated, when the contact plates 34, 35 of the outriggers 28, 29 are lowered, the rods 40, 41 of the sinking amount detecting means 36, 37 lower to alter the resistance value of the resistors 48, 49 in proportion to the amount of descent of the plates 34, 35. When the switches 82, 83 are turned on at the time the tractor body 1 has been brought to an approximately horizontal position, a signal indicating the current posture is fed from the resistors 48, 49 to the memory means 80, 81 and is stored therein as a setting signal. If the left contact plate 34 sinks for example into a locally soft ground portion during work as shown in FIG. 8, the sensor plate 42*a* of the detecting means 36 is pushed up relative to the outrigger by contact with the ground to decrease the resistance value of the resistor 48 by a value corresponding to the amount of sinking. The resulting detection signal is fed to the differential means 84, which in turn determines the difference between the setting signal and the detection signal. The difference signal obtained is fed via the change switch 86 to the judging means 74 and the pulse-width modulation means 94. Consequently, in the same manner as already described, a down signal is produced from the comparator 78 of the judging means 74, and the comparator 100 of the means 94 produces a pulse signal which is obtained by subjecting the difference signal to pulse-width modulation with the triangular wave signal a. Via the analog switch 106 and the drive means 112, the control valve 54 is opened at the down side to lower the contact plate 34 of the left outrigger 28 by an amount corresponding to the amount of sinking. With the descent of the plate 34, the sensor plate 42*a* of the detecting means 36 relatively lowers to contact the ground, increasing the resistance value of the resistor 48. Upon the current detection signal matching the setting signal, the valve 54 is returned to the neutral position. In this way, the tractor body 1 is controlled to a generally horizontal position at all times at the specified level above the ground.

When earth is to be dumped out from the bucket 18 at a sidewise position during the excavation by the backhoe 12, the boom 16 is raised, and the pivotal frame 15 and the boom 16 are thereafter moved about the vertical pivots 14 toward the dumping position by extending or contracting the frame cylinders 22, 23. More specifically, the control lever 44 is shifted leftward to thereby decrease the resistance value of the variable resistor 88, whereby an instruction signal is given which is proportional to the amount of the shift. When fed to the judging means 115, the instruction signal, which is small, is interpreted as being a righward moving instruction by the comparator 117, which in turn produces a righward moving signal to turn on the analog switch 108. On the other hand, the instruction signal b is fed to the comparators 99, 102 of the pulse-width modulation means 96 and compared with the triangular wave signal a of the oscillator 93. Since the instruction signal b is lower than the midpoint voltage in this case, the comparator 102 compares the two signals and produces a pulse signal c which is on when the instruction signal b is smaller than the signal a in reverse relation to the signal c shown in FIG. 7. The pulse width of the signal c is greater when the difference between the two signals is greater. Consequently, the drive means 114 is operated via the analog switch 108, energizing the right solenoid 62 of the electromagnetic valve 60 and thereby opening the valve 60 at the rightward moving side to a degree in proportion to the pulse width to supply the working fluid to the frame cylinders 22, 23. The pivotal frame 15 and the boom 16 are therefore moved righward about the pivots 14. In this case, the boom 16 moves at a speed proportional to the amount of shift of the control lever 44 and is therefore movable at a desired speed.

Upon the boom 16 reaching the dumping position, the control lever 44 is returned to the neutral position to hold the frame cylinders 22, 23 out of operation and stop the frame 15 and the boom 16 at the dumping position. Earth is then dumped out of the bucket 18.

To return the boom 16 thereafter to the central excavating position, the target position is preset by the variable resistor of the setting means 89. The boom 16 can then be automatically stopped at the target position merely by depressing the manual-automatic change switch 92 at the upper end of the control lever 44. This enables the operator to direct his attention only to the movement of the arm 17 and the bucket 18.

More specifically, the position detecting means 24 detects the current position of the pivotal frame 15 for the variable resistor 91 to feed the resulting signal to the differential means 90, which determines the difference between the setting signal from the setting means 89 and the detection signal from the position detecting means 24. The difference signal obtained is fed to the judging means 115 and the pulse-width modulation means 96 via the change switch 92. In the same manner as already described, the judging means 115 interprets the instruction given as being a leftward moving instruction and produces a leftward moving signal to turn on the analog switch 105. On the other hand, the modulation means 96 subjects the difference signal to pulse-width modulation, with the result that the left solenoid 61 of the electromagnetic control valve 60 is energized by the drive means 111. The valve 60 is therefore opened at the righward moving side to a degree proportional to the difference signal, extending or contracting the frame cylinders 22, 23 to move the pivotal frame 15 and the boom 16 about the vertical pivots 14 toward the target position. Since the difference signal diminishes as the boom 16 approaches the target position, the boom 16 moves at a gradually decreasing speed. Upon the boom reaching the target position, the difference signal dimishes to zero, so that the valve 60 is returned to the neutral position. Thus, the frame 15 and the boom 16 can be stopped at the target position smoothly.

This movement is effected only while the change switch 92 is held depressed. The pivotal frame 15 can be stopped in the course of the movement by releasing the change switch 92.

The vehicle and the working machine are not limited to the tractor and the backhoe, respectively.

Figure 13:
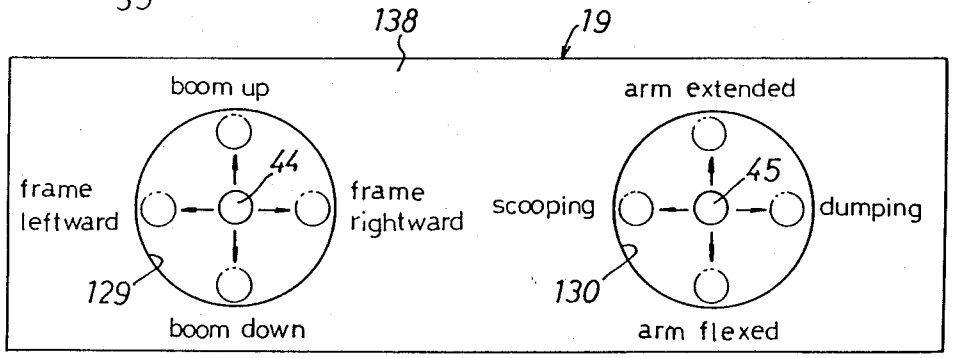
FIGS. 9 to 14 show another embodiment of the invention.

FIGS. 9 to 14 show another embodiment of the present invention. With reference to FIG. 13, the control lever 44 moves the pivotal frame 15 rightward or leftward when shifted rightward or leftward, and moves the boom 16 upward or downward when shifted forward or rearward. The control lever 45 causes the bucket 18 to perform a dumping or scooping action when shifted rightward or leftward and moves the arm 17 upward or downward when shifted forward or rearward.

Figure 9:
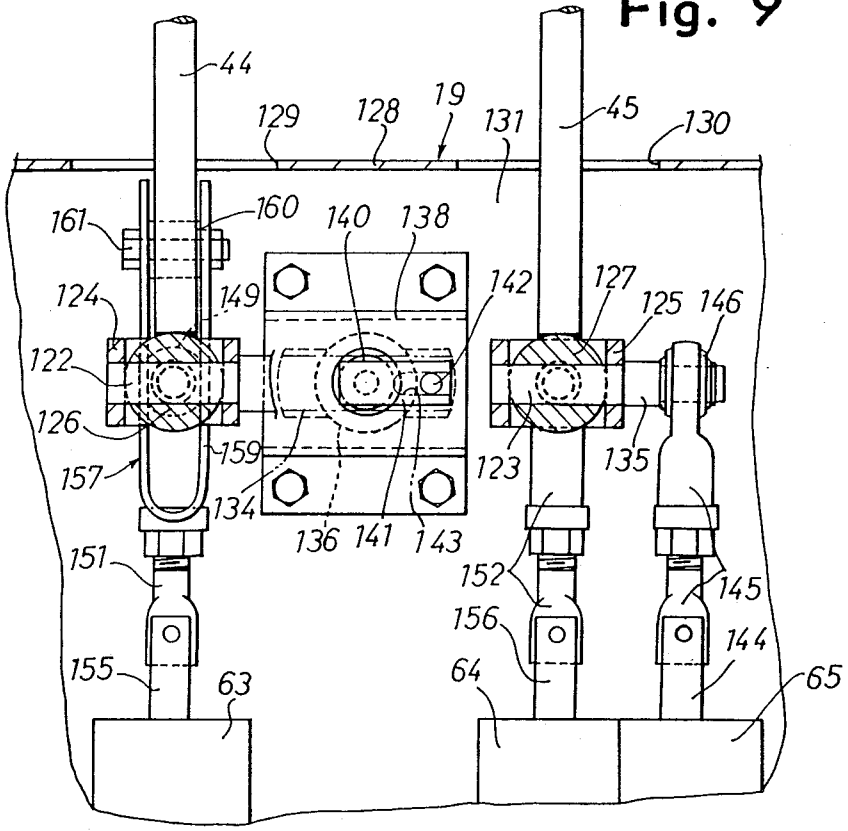
Figure 10:
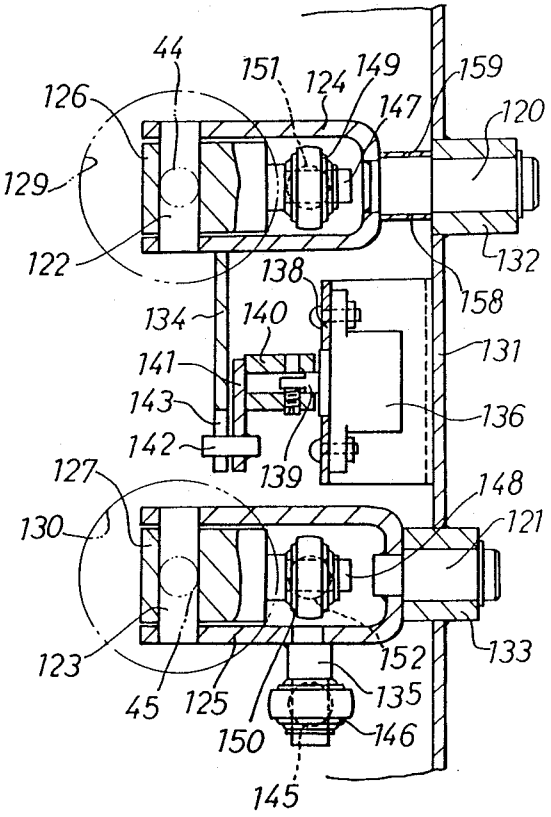
Figure 12:
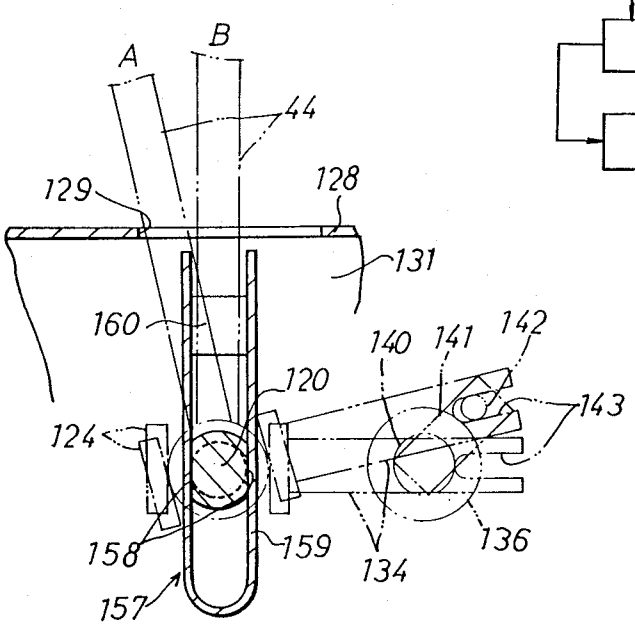

With reference to FIGS. 9 and 12, the control levers 44 and 45 are mounted on a control box 19. Within the control box 19, the control levers 44, 45 are rightwardly, leftwardly, forwardly and rearwardly movably supported by first movable members 124, 125 and second movable members 126, 127 respectively movable about the axes of first shafts 120, 121 and the axes of second shafts 122, 123 intersecting the respective axes at right angles therewith. The control levers 44, 45 are secured to the second movable members 126, 127, respectively, and projected upward through openings 129, 130 formed in the top plate 128 of the control box 19. The first movable members 124, 125 are U-shaped and respectively have the first shafts 120, 121 which extend in the front-to-rear direction. The first shafts 120, 121 are rotatably inserted through boss portions 132, 133 secured to a support plate 131 for the control box 131. The first movable members 124, 125 are provided with laterally projecting arms 134, 135, respectively. The arm 134 is coupled to electric instruction means 136 for controlling the movement of the pivotal frame 15. The other arm 135 is coupled to a bucket control valve 65. The electric instruction means 136 comprises a variable resistor 88, and is fixed to the support plate 131 by a bracket 138 at one side of the first shaft 120. The means 136 has a movable rod 139 projecting forward beyond the bracket 138 and having attached thereto an arm 141 by a tubular member 140. The arm 141 carries at its forward end a pin 142 which is engaged in a cutout 143 formed in the arm 134 of the first movable member 124. The control valve 65, which is attached to the support plate 131, has a vertical spool 144 connected to the arm 135 on the first movable member 125 by rods 145 and a ball joint 146. In the front-end inside portions of the first movable members 124, 125, the second movable members 126, 127 are supported by the second shafts 122, 123, respectively, which extend in the right-to-left direction. The second movable members 122, 123 are provided with rearwardly projecting arms 147, 148 in alignment with the axes of the first shafts 120, 121, respectively. Control valves 63, 64 attached to the support plate 131 for controlling the boom and the arm 17 have spools 155, 156, respectively, The arms 147, 148 are connected at their forward ends to the respective spools 155, 156 by ball joints 149, 150 and rods 151, 152.

The control valves 65, 63, 64 are three-position shiftable mechanical valves each having a spring for returning their spools 144, 155, 156 to the neutral position. When operating these valves, the control levers 44, 45 are subjected to resistance produced by the sliding movement of the spools 144, 155, 156 and by the action of the return springs. On the other hand, the electric instruction means 136, which comprises the variable resistance 88, etc., is operable with slight mechanical resistance. Accordingly, to render the control lever 44 movable for operating the instruction means 136 with approximately the same resistance as encountered when the levers 44, 45 are moved for operating the valves 63, 64, 65, the base portion of the control lever 44, i.e. the first shaft 120, is provided with resistance means 157. The resistance means 157 comprises a U-shaped plate spring 159 adapted to clamp a pair of flat faces 158 formed in the first shaft 120. The plate spring 159 is fastened by a bolt 161 to a projection 160 secured to the support plate 131. The flat faces 158 of the first shaft 120 are in face-to-face contact with the plate spring 159 when the output of the instruction means 136 is zero..

Figure 14:
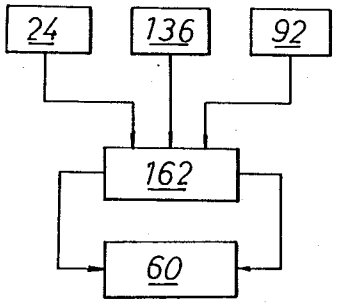

With reference to FIG. 14, the instruction means 136 is connected along with the position detecting means 24 and change switch 92 to a control circuit 162, which is connected to a magnetic control valve 60 for controlling the frame cylinders 22, 23.

When the control lever 44 is shifted forward or rearward, the second movable member 126 is moved about the second shaft 122 to move the spool 155 of the control valve 63 upward or downward through the arm 147, rod 151, etc. and switch the control valve 63 for raising or lowering the boom. Consequently, the boom cylinder 25 is extended or contracted to raise or lower the boom 16.

The control lever 44, when shifted righward or leftward, moves the first movable member 124 about the first shaft 120, causing the arm 141 to move with the movable rod 139 of the instruction means 136 through the arm 134 and pin 142, whereupon the instruction means 136 produces an altered instruction signal. When the lever is shifted leftward, the frame cylinders 22, 23 are extended or contracted through the control valve 60 to move the pivotal frame 15 leftward. If the lever is shifted rightward, the pivotal frame 15 is conversely moved rightward.

At this time, the first shaft 120 rotates with the control lever 44, so that the plate spring 159 clamping the flat faces 158 gives the lever 44 resistance against the shift. The resistance is approximately the same as that involved in the forward or rearward shift of the control lever 44, so that the lever 44 feels the same without difference when shifted forward or rearward, and rightward or leftward. Furthermore, the control lever 44 can be held in its neutral position by the plate spring 159. If the control lever 44 in the phantom-line position A shown in FIG. 12 is released from the hand, the spring 159 acts to return the lever 44 to the neutral position B.

The resistance involved in shifting the lever is adjustable by forming a slot in the plate spring 159 and making the position of the spring adjustable vertically relative to the projection 160. Furthermore, a spacer or the like may be interposed between the spring 159 and the projection 160 to adjust the sidewise width of the plate spring.

What is claimed is:

1. A control system for a working machine which has a boom equipped with a working implement at its forward end and pivoted to a vehicle body movably about a vertical axis, and a control valve for controlling the movement of the boom, the control system being characterized in that the system comprises means for setting a target position where the boom is to be stopped to produce a setting signal, means for detecting the moved position of the boom to produce a detection signal, differential means for determining the difference between the setting signal and the detection signal to produce a difference signal, means for judging the direction of movement of the boom from the magnitude of the difference signal from the differential means, pulse-width modulation means for subjecting the difference signal to pulse-width modulation to produce a pulse signal, and drive means for driving the control valve by the pulse signal in the direction of movement of the boom judged by the judging means in proportion to the difference signal.

2. A control system as defined in claim 1 which further comprises instruction means for giving an instruction to pivotally move the boom, and a change switch for feeding the instruction signal from the instruction means and the difference signal from the differential means selectively to the judging means and the pulse-width modulation means which are subsequently provided.

3. A control system as defined in claim 2 wherein the change switch is provided at the upper end of a control lever for operating the instruction means.

4. A control system as defined in claim 2 or 3 wherein the instruction means comprises a variable resistor for giving an instruction signal varying in proportion to the amount of shift of a control lever.

5. A control system as defined in claim 1 or 2 wherein the pulse-width modulation means compares a triangular wave signal from a triangular wave oscillation means with the difference signal from the differential means or with an instruction signal from instruction means by a comparator.

6. A control system as defined in claim 1 wherein each of the setting means and the position detecting means is a variable resistor.

7. A control system for a working machine which has a boom equipped with a working implement at its forward end and pivoted to a vehicle body movably about a vertical axis comprising a control lever movable about two axes intersecting each other at right angles and said lever providing means for operating a mechanical control valve when moved about one of said axes and means for operating electric instruction means when moved about the other of said axes, the boom being pivotally movable by a control valve in response to an instruction given thereto by the electric instruction means, and the control lever being provided at its base portion with resistance means for giving resistance to the control lever only upon movement of the lever for operating electric instruction means so as to render the control lever shiftable with substantially the same resistance for operating the electric instruction means and for operating the mechanical control valve.

8. A control system as defined in claim 7 wherein the resistance means comprises a U-shaped plate spring for clamping a pair of flat faces formed in a shaft supporting the control level, and the plate spring is attached to a fixed member.

9. A control system as defined in claim 8 wherein a projection on the fixed member is provided between the open ends of the U-shaped plate spring, and the plate spring is fastened to the projection with a bolt.

10. A control system for a working machine which has a boom equipped with a working implement at its forward end and pivoted to a vehicle body movably about a vertical axis, and a control lever movable about two axes intersecting each other at right angles for operating a mechanical control valve and electric instruction means, the boom being pivotally movable by a control valve in response to an instruction given thereto by the instruction means, the control system being characterized in that the control lever is provided at its base portion with resistance means for giving resistance to the control lever so as to render the control lever shiftable with substantially the same resistance for operating the instruction means and for operating the mechanical control valve, the control system comprising means for setting a target position where the boom is to be stopped to produce a setting signal, means for detecting the moved position of the boom to produce a detection signal, differential means for determining the difference between the setting signal and the detection signal to produce a difference signal, means for judging the direction of movement of the boom from the magnitude of an input signal, pulse-width modulation means for subjecting the input signal to pulse-width modulation to produce a pulse signal, drive means for proportionally driving a control valve by the pulse signal in the direction of movement of the boom judged by the judging means, and a change switch for feeding the instruction signal from the instruction means and the difference signal from the differential means selectively to the judging means and the pulse-width modulation means.

11. A control system as defined in claim 7, wherein said control lever is supported by support means including a shaft, said shaft serving as a pivot and including the axis about which the control lever is moved when actuation of the electrical instruction means is intended, and said resistance means being located to provide resistance to the turning movement of said shaft.

* * * * *